US006354376B1

(12) United States Patent
De Baan

(10) Patent No.: US 6,354,376 B1
(45) Date of Patent: Mar. 12, 2002

(54) APPARATUS FOR TRANSFERRING FLUID BETWEEN THE SEABED AND A FLOATING VESSEL

(75) Inventor: Jacob De Baan, Maassluis (NL)

(73) Assignee: Bluewater Terminal Systems N.V. (NL)

( * ) Notice: Subject to any disclaimer, the term of this patent is extended or adjusted under 35 U.S.C. 154(b) by 0 days.

(21) Appl. No.: 09/523,565

(22) Filed: Mar. 10, 2000

(30) Foreign Application Priority Data

Mar. 11, 1999 (GB) ..... 9905617

(51) Int. Cl.[7] ..... B63B 32/44

(52) U.S. Cl. ..... 166/338; 166/302; 405/158; 405/169

(58) Field of Search ..... 166/338, 346, 166/352, 355; 405/158, 168.1, 169

(56) References Cited

U.S. PATENT DOCUMENTS 3,677,310 A * 7/1972 Dobler et al. ..... 141/1
5,944,448 A * 8/1999 Williams ..... 405/169

FOREIGN PATENT DOCUMENTS

GB 2330157 A 4/1999
WO WO 87/05577 A 9/1987

* cited by examiner

*Primary Examiner*—William Neuder
(74) *Attorney, Agent, or Firm*—Fulwider Patton Lee & Utecht LLP

(57) ABSTRACT

Apparatus is disclosed for transferring fluid between a point (5) on the seabed, such as a wellhead, and a floating vessel (1). The apparatus comprises a flexible pipeline (4), the upper end of which is attachable to the vessel (1). A second flexible pipeline (8) is attached at one end to the wellhead (5). A structure (6) is mounted on the seabed and includes a member (7) which is movable relative to the structure (6). The lower end of the first pipeline (4) and the upper end of the second pipeline (8) are mounted on an end of the movable member (7) which is remote from the seabed structure (6). When the first flexible pipeline is stretched out in response to the vessel (1) moving about under the action of wind and current, the movable member (7) is displaced relative to the seabed structure (6) in order to allow the pipeline (4) a greater range of movement before it becomes stretched beyond its safe limit. The apparatus is particularly useful in shallow water where the length of the flexible pipeline (4) is not sufficient to take up very much movement of the vessel (1).

6 Claims, 2 Drawing Sheets

PRIOR ART

APPARATUS FOR TRANSFERRING FLUID BETWEEN THE SEABED AND A FLOATING VESSEL

In offshore oil production much use is made of floating production vessels which are stationed in the vicinity of submarine wellheads. Oil produced in the wells is delivered from the wellheads to the vessel through flexible hoses. The hoses are required to be flexible because the floating vessels are subject to significant dynamic motion and displacement from their nominal position due to the action of wind, wave and current and a continuity in the fluid transfer must be maintained despite such displacements of the vessel.

In many instances, the nominal position of the vessel is maintained by so-called single point mooring systems, which allow the vessel to weathervane to take up a natural heading which offers the least resistance to wind, wave and current.

In many situations, the depth of water beneath the keel of the vessel is sufficient to allow a sufficiently slack flexible hose system to be fitted. Consequently, the hose system can follow all the vessels movements and displacements as afforded by the single point mooring system, by simply adjusting its configuration.

However, in very shallow depths of water this is not always the case and it may not be possible to provide a sufficiently long and slack flexible hose to accommodate the movements of the vessel. Therefore, the hose system may become too extended and damage to it may result.

The present invention provides apparatus for transferring fluid between a point on the seabed and a floating vessel, comprising a first flexible tube providing a fluid conduit and having a first end attachable to a floating vessel and a second end; a second flexible tube providing a fluid conduit and having a first end attached to a point on the seabed and a second end attachable for fluid communication with the first tube; and a structure mounted on the seabed having a movable member mounted thereon to which the second ends of the first and second tubes are attached, the movable member beings displaceable relative to the seabed structure in response to load on the first tube exceeding a predetermined threshold.

The apparatus therefore provides additional displacement capability which prevents the first hose from becoming stretched beyond its design limit.

In a first embodiment, the movable member consists of an arm with a first end pivotally mounted to the seabed structure for rotation about the structure and a second end to which the second ends of the first and second tubes are attached.

In an alternative embodiment, the movable member consists of a body mounted to the seabed structure for linear movement relative thereto.

In this case, the seabed structure may define a guide track in which the body is slidably mounted.

The first end of the second hose may be attached to the seabed structure which carries the movable member or may be attached to a point on the seabed displaced from the seabed structure.

The present invention will now be described in detail, by way of example only, with reference to the following drawings in which.

Figure 1:
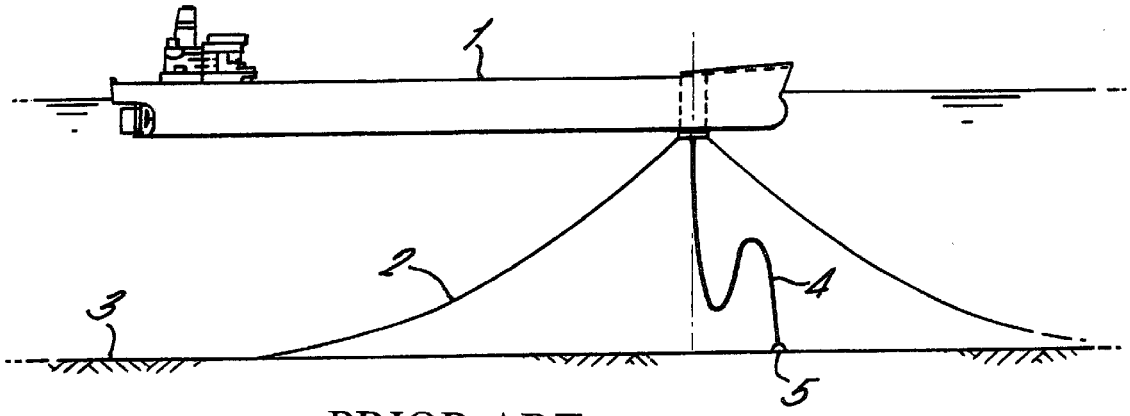
FIG. 1 illustrates a conventional system with a moored vessel and flexible hose connecting the vessel to a seabed wellhead.

With reference to FIG. 1, this shows a conventional system whereby a floating vessel 1 is anchored to the seabed 3 by a chain or chain/wire combination 2. A flexible hose system 4 connects the vessel with a given point 5 on the seabed, such as a wellhead.

Figure 2:
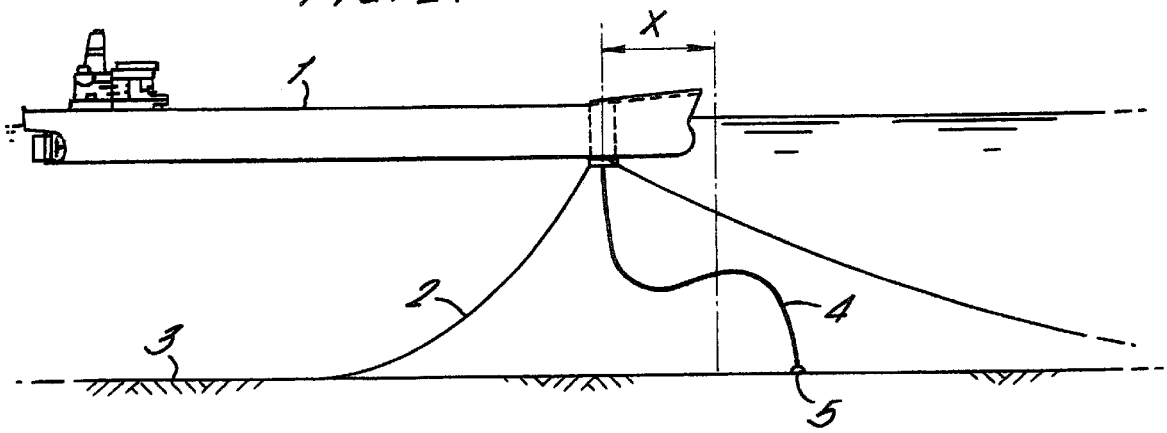
PRIOR ART FIG. 2.
FIG. 2 shows the system of FIG. 1 when the vessel has been displaced due to the action of wind, wave or current.

FIG. 2 shows the same arrangement but now the vessel has been displaced by an amount X due to the action of wind, wave and current. The flexible hose system 4 has sufficient length and flexibility to accommodate this displacement by adjusting its shape.

Figure 3:
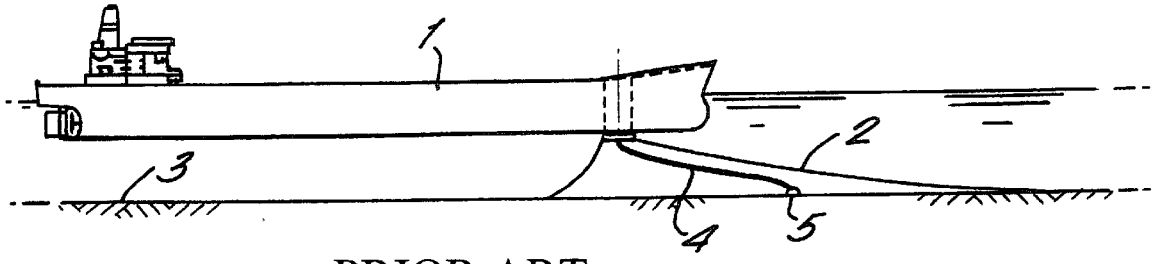
PRIOR ART FIG. 3.
FIG. 3 shows a similar situation to FIG. 2 in shallower water.

FIG. 3 shows a conventional system used in shallower water, for example where the depth is about 30% of that in FIGS. 1 and 2. In this case, when the vessel is displaced, due to the insufficient water depth beneath the keel, the hose system 4 is too short to fully accommodate the displacement of the vessel. The hose 4 becomes stretched beyond its design limit and can no longer operate and convey fluid safely.

Figure 4:
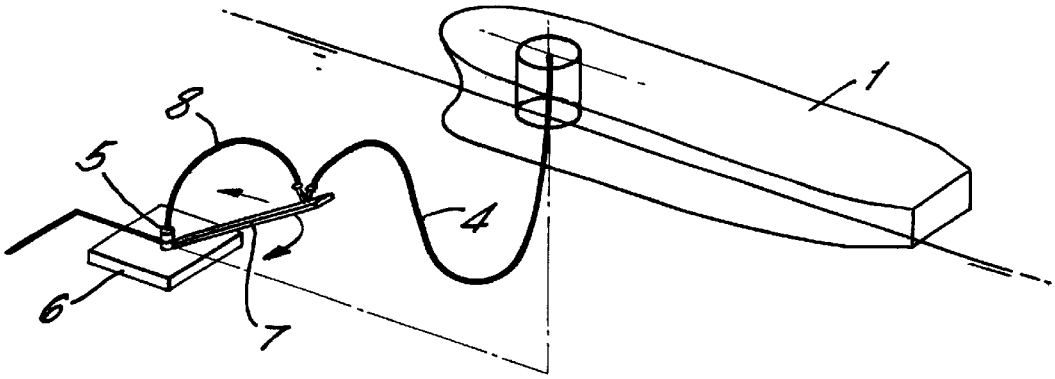
FIG. 4 shows a first embodiment of the apparatus of the present invention.
Figure 5:
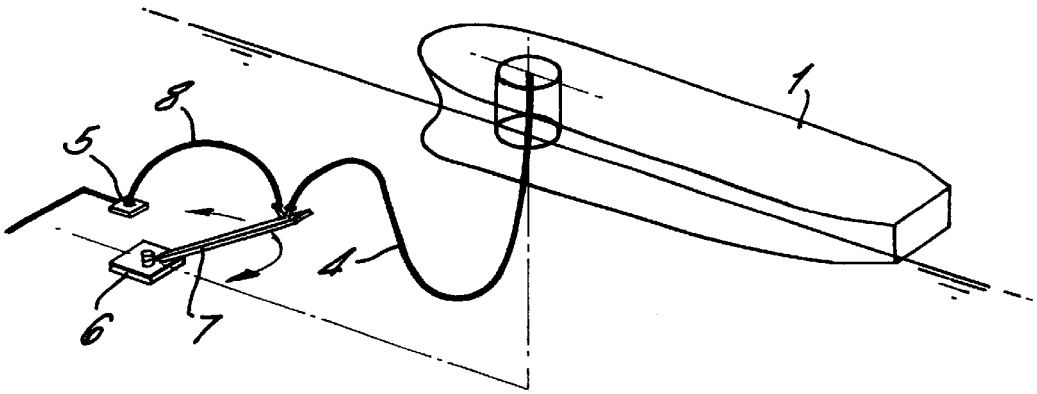
FIG. 5 shows a second embodiment of the present invention.

FIG. 4 shows a first embodiment in accordance with the present invention which provides a solution to this problem. In this case, a seabed structure 6 is provided which carries a movable member 7. In this example, the movable member 7 consists of an arm pivotally mounted to the seabed structure for rotation about the structure as indicated by the arrows in a substantially horizontal or slightly inclined plane. The lower end of the flexible hose system 4, which was previously connected to a point on the seabed 5, is now connected to the end of the arm 7 remote from the seabed structure 6. A second flexible hose 8 is provided, with one end attached to the end of the arm 7 so as to be in fluid communication with the first hose 4 and the other end attached to the wellhead 5. In this case, the seabed structure 6 which carries the movable arm 7 is coincident with the wellhead 5 to which the second hose 8 is connected. However, as illustrated in FIG. 5, the wellhead 5 may be at a location spaced from the seabed structure 6.

In operation, if the vessel 1 is displaced and therefore stretches out the first hose 4, once the load imposed on the hose 4 exceeds a given point, it will cause the movable arm 7 will rotate so as to accommodate the stretching of the hose 4 and allow it to resume a more normal configuration. Thus, the free end of the arm 7 will rotate such that the tangent to its arc rotation is directed approximately in the same direction as the vessel displacement.

Figure 6:
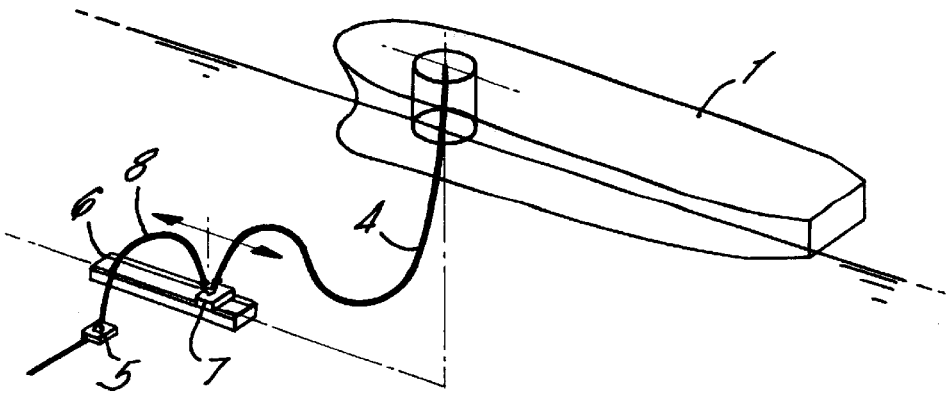
FIG. 6 shows a third embodiment of the present invention.

A third embodiment of the invention is illustrated in FIG. 6. In this case, the movable member 7 consists of a body mounted for linear movement on a seabed structure 6. For example, the seabed structure 6 may define a guide track along which the movable body can slide. Once again two flexible hoses 4 and 8 are required which are attached in fluid communication with each other at the movable member 7. The other end of the second flexible hose 8 is attached to the wellhead 5 at a location displaced from the seabed structure 6.

It will be appreciated that the exact configuration of seabed structure and movable member can be altered as desired to provide rotational or linear movement or a combination of the two in any appropriate form which will allow the lower end of the hose 4 to be displaced relative to the wellhead on the seabed without becoming stretched beyond its design limit.

What is claimed is:

1. Apparatus for transferring fluid between a point on the seabed and a floating vessel, comprising a first flexible tube providing a fluid conduit and having a first end attachable to a floating vessel and a second end; a second flexible tube providing a fluid conduit and having a first end attached to a point on the seabed and a second end attachable for fluid communication with the second end of the first tube; and a structure mounted on the seabed having a movable member mounted thereon to which the second ends of the first and second tubes are attached, the movable member being displaceable relative to the seabed structure in response to load on the first tube exceeding a predetermined threshold.

2. Apparatus as claimed in claim 1, wherein the movable member comprises an arm having a first end pivotally mounted to the structure mounted on the seabed for rotation about the structure in a substantially horizontal or slightly inclined plane and a second end to which the second ends of the first and second tubes are attached.

3. Apparatus as claimed in claim 1, wherein the movable member comprises a body mounted on the structure mounted on the seabed for linear movement relative thereto and to which the second ends of the first and second tubes are attached.

4. Apparatus as claimed in claim 3, wherein the seabed structure defines a guide track along which the body is slidable.

5. Apparatus as claimed in claim 1, wherein the first end of the second hose is attached to the seabed structure which carries the movable member.

6. Apparatus as claimed in claim 1, wherein the first end of the second hose is attached to the seabed at a point displaced from the seabed structure which carries the movable member.

* * * * *